US005467898A

United States Patent [19]

Hori

[11] Patent Number: 5,467,898

[45] Date of Patent: Nov. 21, 1995

[54] LIQUID FOAM-DISCHARGING, SQUEEZABLE VESSEL

[75] Inventor: Nobuaki Hori, Yokohama, Japan

[73] Assignee: Toyo Seikan Kaisha, Ltd., Tokyo, Japan

[21] Appl. No.: 329,790

[22] Filed: Oct. 27, 1994

Related U.S. Application Data

[63] Continuation of Ser. No. 56,879, May 5, 1993, abandoned.

[51] Int. Cl.[6] ..... B05B 11/04

[52] U.S. Cl. ..... 222/190; 222/211; 239/327

[58] Field of Search ..... 222/39, 190, 211, 222/212, 481, 482, 521; 239/327, 343

[56] References Cited

U.S. PATENT DOCUMENTS

| | | | |
|---|---|---|---|
| 3,230,661 | 1/1966 | Gleason | 222/39 X |
| 3,608,782 | 9/1971 | Sathicq | 222/94 |
| 3,788,521 | 1/1974 | Laauwe | 222/94 |
| 3,876,111 | 4/1975 | Swain | 222/94 |
| 4,265,374 | 5/1981 | Sebalos | 222/95 |
| 4,429,834 | 2/1984 | Ito | 222/190 X |
| 4,432,496 | 2/1984 | Ito | 222/190 X |
| 4,509,661 | 4/1985 | Sugizaki et al. | 222/190 |
| 4,531,659 | 7/1985 | Wright | 222/190 |
| 4,615,467 | 10/1986 | Grogan et al. | 222/190 X |
| 4,809,884 | 3/1989 | Stackhouse | 222/153 |
| 4,836,416 | 6/1989 | Shalgi et al. | 222/48 |
| 4,881,666 | 11/1989 | Tullman et al. | 222/386.5 |
| 5,033,654 | 7/1991 | Bennett | 222/190 |
| 5,037,006 | 8/1991 | Kock | 222/190 |
| 5,048,750 | 9/1991 | Tobler | 222/190 X |
| 5,158,206 | 10/1992 | Kobayashi et al. | 222/39 |
| 5,219,102 | 6/1993 | Wright | 222/190 |

FOREIGN PATENT DOCUMENTS

| | | |
|---|---|---|
| 63-13810 | 4/1963 | Japan . |
| 57-149802 | 9/1982 | Japan . |
| 57-147602 | 9/1982 | Japan . |
| 60-20262 | 5/1985 | Japan . |

*Primary Examiner*—Andres Kashnikow
*Assistant Examiner*—Lisa Douglas
*Attorney, Agent, or Firm*—Armstrong, Westerman, Hattori, McLeland and Naughton

[57] ABSTRACT

A liquid foam-discharging, squeezable bottle is disclosed, which has a twist cap screwed onto the vessel body, the twist cap being composed of an inner cap and outer cap. The inner cap has formed therein two independent fluid-passing mechanisms at about its central position and at a position adjacent thereto, respectively. One of the fluid-passing mechanism is a liquid foam-generating mechanism comprising a pipe-shaped member having a net screen on one end thereof, and the other functions as a check valve. The outer cap has engaged inside of the foam-discharging opening an adapter fully covered with a net screen on one end located nearer to the contents of the vessel. This vessel enables one to rapidly discharge a uniform, creamy liquid foam by simple squeezing operation and, if desired, the foam can be sprayed by using an adapter having a small-diameter nozzle.

4 Claims, 6 Drawing Sheets

Fig.8
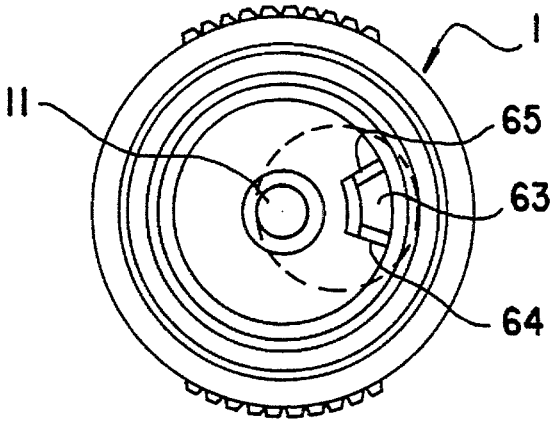
Fig.9
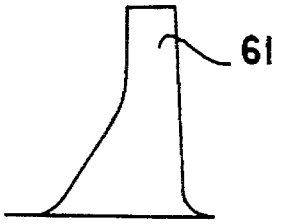
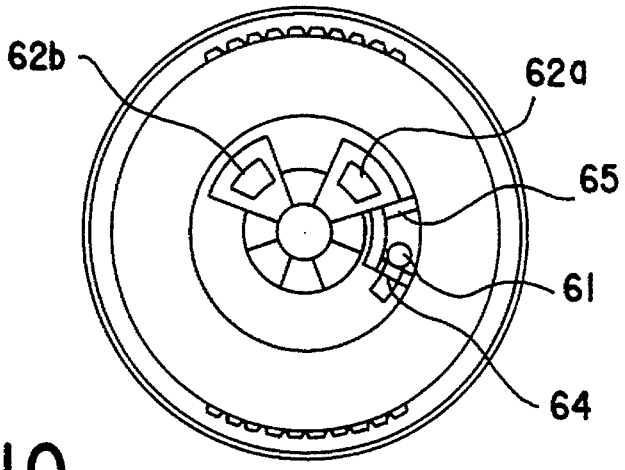
Fig.10

LIQUID FOAM-DISCHARGING, SQUEEZABLE VESSEL

This application is a continuation of application Ser. No. 08/056/879 filed May 5, 1993, now abandoned.

BACKGROUND OF THE INVENTION

This invention relates to a foam-discharging, squeezable vesssel and, more particularly, it relates to a liquid foam-discharging, squeezable vessel which enables one to conduct rapid and repeated discharge of uniform and fine liquid foam by simple operation.

Conventional vessels for retaining a liquid detergent for cleaning panes or wall surfaces of bathrooms have the defect that, when applied to a perpendicular plane as a liquid, the detergent runs downward, thus failing to exhibit its function. Therefore, it has recently been proposed to discharge the detergent or like liquid as a foam.

For example, Japanese Examined Patent Publication No. 60-20262 discloses a liquid foam-discharging, squeezable vessel having an air inlet passage with a check valve and a separatedly positioned foam-generating passage, wherein the ratio of the area of opening for outlet pipe-holding pipe joint to the cross area of the inlet passage is limited to a particular range and wherein average size of the air-passing pores of a porous body provided on the way of the foam-generating passage is limited to a specific size.

Japanese Examined Utility Model Publication No. 63-13810 discloses a similar liquid foam-discharging, squeezable vessel wherein the foam-generating means comprises a porous plate provided on the upstream side and a net or nonwoven fabric on the downstream spaced from the porous plate.

On the other hand, there have been known those liquid foam-discharging, squeezable vessels which have a fine net provided in the nozzle. For example, Japanese Examined Utility Model Publication No. 57-147602 discloses a liquid foam-discharging, squeezable vessel which has a porous cylinder within a circular cap intended for foaming the retained liquid by introducing air and the liquid thereinto and, in addition, a net in the nozzle. Japanese Examined Utility Model No. 57-149802 discloses a liquid foam-discharging, squeezable vessel which similarly has a porous cylinder within a circular cap with the central portion of the porous cylinder being excluded and a valve being provided therein which functions to prevent a liquid content from passing therethrough from under the valve and to introduce air from outside. When the body of the disclosed vessel is squeezed, air and a liquid content are introduced into the porous cylinder, and the mixture is foamed upon being ejected from the porous cylinder, the foam being made finer by a net provided in the nozzle.

However, the vessel disclosed in Japanese Examined Patent Publication No. 60-20262 has the defects that, though it can eject a liquid foam in a well foamed state, it requires a sophisticated technique of controlling the ratio of opening area of pipe joint to cross area of inlet passage and the average size of cells of the porous body provided on the way of the foam-generating passage, and that, since the liquid is foamed upon passing through the porous body, the porous body undergoes gradual clogging.

The vessel disclosed in Japanese Examined Utility Model No. 63-13810 has the defect that, since foaming and air-sucking upon unsqueezing are conducted through one and the same pipe, squeezing and unsqueezing of the squeezable vessel can not be conducted at a high speed, thus ejection of liquid foam not being conducted smoothly.

In addition, the vessels described in Japanese Unexamined Utility Model Nos. 57-147602 and 57-149802 have the following defects, though they give finely foamed product. That is, since first foaming is conducted in the porous cylinder wherein the liquid and the air are mixed with each other and the second foaming is conducted with the net provided in the nozzle, the vessel described in Japanese Unexamined Utility Model No. 57-147602 allows the air to proceed through pores having larger pore size upon sucking air after discharge of liquid foam, whereas the vessel described in Japanese Unexamined Utility Model No. 57-149802 permits the air to proceed through the valve provided at the top of the porous cylinder. Thus, in both cases, the air travels through the pipe provided at the center of the vessels to reach the air space. That is, the sucked air travels through the liquid retained in the vessel to reach the air space, upon which foaming of the liquid takes place. This can cause insufficient intake of the air into the air space, or can cause gradual clogging of the porous cylinder. Such vessels are not suitable for repeatedly discharging liquid foam, and can only be used as vessels for shaving cream which require once or twice discharge of liquid foam.

The inventors have long studied for overcoming the above-described defects of the liquid foam-discharging squeezable vessel, and have formerly completed a vessel having two different fluid-passing mechanisms—one for foaming upon squeezing the vessel, and the other for sucking air upon unsqueezing the vessel. That is, the foaming operation is conducted in a fluid-passing mechanism using two screens, and the air-sucking operation is conducted through an independent check valve mechanism. This vessel has been filed as Japanese Utility Model Application Nos. H3-87879 and H3-87880.

SUMMARY OF THE INVENTION

As a result of continued inventigations, the inventors have completed a vessel which has a structure capable of forming liquid foam having smaller foam cell size and giving a creamy appearance.

It is an object of the invention to provide a liquid foam-discharging squeezable vessel which can rapidly and repeatedly be squeezed and unsqueezed to discharge liquid foam having uniform and extremely creamy fine structure.

The above-described objects can be attained by a vessel which has a twist cap screwed onto the vessel body, said twist cap being composed of an inner cap and an outer cap, said inner cap having formed therein two independent fluid-passing mechanisms for foaming the liquid and for sucking outside air, respectively, and said outer cap having engaged inside of the foam-discharging opening or nozzle a pipe-shaped member (hereinafter sometimes merely referred to as "adapter") fully covered with a net screen on one end locating nearer to the content of the vessel.

Other objects, features and advantages of the present invention will become apparent from the detailed description of the preferred embodiments of the invention to follow.

BRIEF DESCRIPTION OF DRAWINGS

FIG. 8 is a plane view showing the structure of the stopper provided in the outer cap.

FIG. 9 is a vertical sectional view showing the sound-producing boss.

FIG. 10 is an upper sectional view showing the state wherein the outer cap and the inner cap are engaged with each other.

Figure 1:
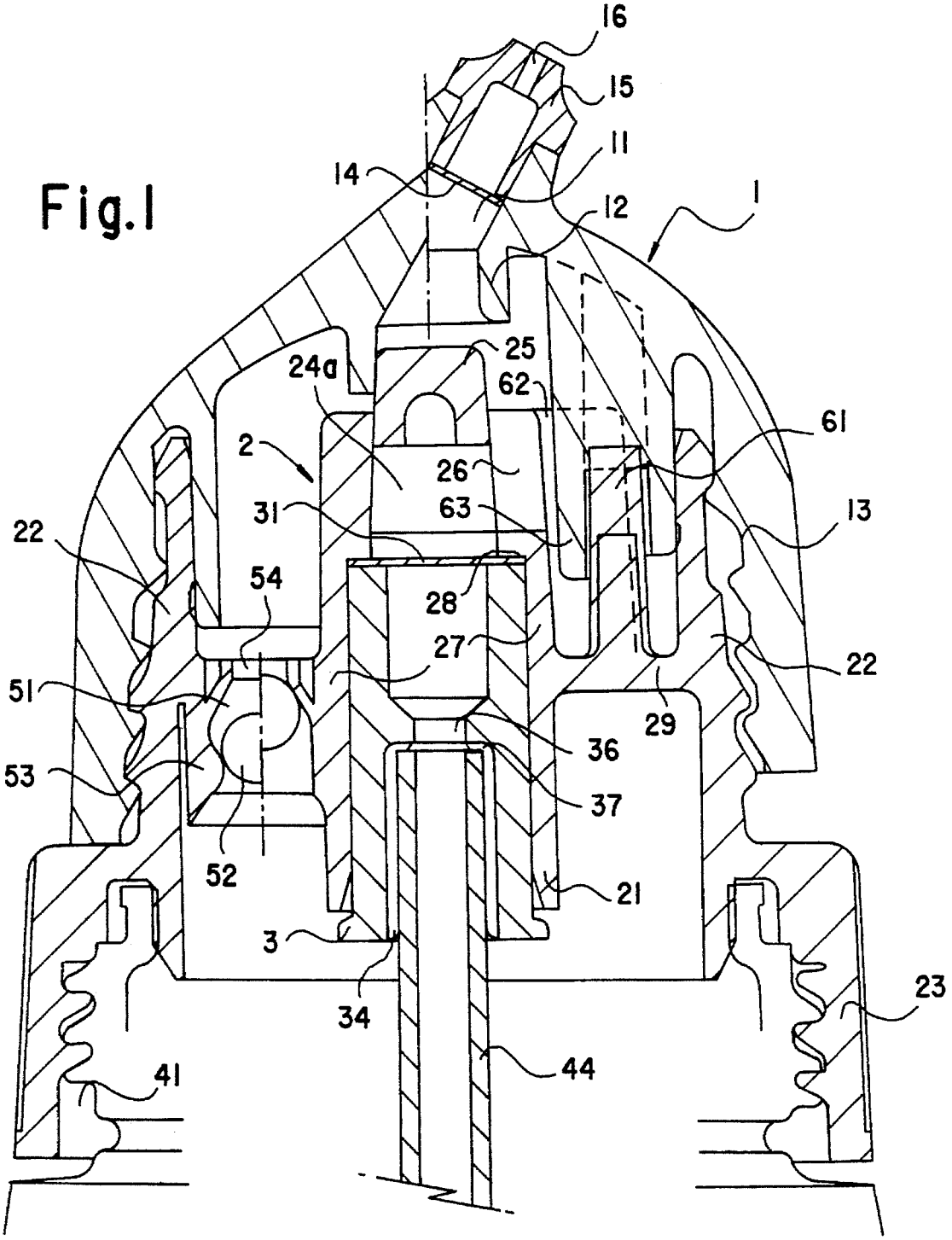
FIG. 1 is a vertical sectional view showing one embodiment of the twist cap of a liquid foam-discharging squeezable vessel of the present invention.

In these figures, numeral 1 designates an outer cap, numeral 2 an inner cap, 3 a pipe joint, 4 a vessel, 5 an inside plug, 11 outer cap nozzle, 12 a cyclic ring, 13 screwed portion of the outer cap, 21 screwed portion of the pipe joint, 22 circular wall in the inner cap, 23 screwed portion of the inner cap onto the vessel, 24*a* central opening, 25 the top of the inner cap, 26 an opening of the inner cap for discharging liquid foam, 27 pipe-shaped wall, 28 jaw, 29 interstructure of the inner cap, 31 a screen, 32 a pipe-shaped member, 33 a jaw, 34 vertical groove, 35 depression, 36 narrow opening, 41 neck of the vessel, 42 liquid, 43 air space, 44 a pipe, 51, 51*a* and 51*b* check valve mechanism, 52, 52*a* and 52*b* a ball, 53, 53*a* and 53*b* a supporting piece, 54, 54*a* and 54*b* an opening of the check valve, 55, 56 and 58 an opening, 57 a stopper, 61 a sound-producing boss, 62*a* and 62*b* a first stopper, 63 a second stopper, 64 a first interstructure, and 65 a second interstructure.

DETAILED DESCRIPTION OF THE PREFERRED EMBODIMENTS OF THE INVENTION

According to the present invention, there is provided a liquid foam-discharging squeezable vessel which comprises a squeezable vessel body and a twist cap screwed onto the body, said twist cap composed of an outer cap and an inner cap, said inner cap being screwed onto the neck of the vessel body by the screw portion formed inside the periphery extending downward, two independent fluid-passing mechanisms being provided at about the center and at a position adjacent to the center within the inner cap, one of said fluid-passing mechanisms being a pipe-shaped portion functioning as a check valve mechanism which contains therein a vertically movable ball, the upper opening of said pipe-shaped member being capable of coming into continuous contact with said ball, the lower opening of said pipe-shaped member being capable of coming into point-to-point contact, the other fluid-passing mechanism being an inserted pipe-shaped member having an opening fully covered by a net screen, and the outer cap having an nozzle fully covered with a net screen on one end located nearer to the contents of the vessel.

The pipe-shaped member, or adapter, serves to enhance sealing effect of the check valve mechanism upon squeezing the vessel and, therefore, leakage flow of the air through the check valve is avoided. Since the air inside the vessel is directed to the net screen in the twist cap without any leakage, the first-step foaming smoothly proceeds, followed by further foaming in the adapter portion to discharge creamy foam.

Further, the net screen provided at one end of the adapter permits to use only one screen in the inner cap. However, as in the aforesaid preceding applications, the screen may of course be provided at each end of the pipe-shaped member.

Still further, liquid foam may be spattered by reducing the size of the nozzle in the adapter, which enables one to apply the foam to a place difficult to approach or to a narrow groove. Alternatively, the foam may be applied with a large width by employing a slit-shaped nozzle. Thus, the shape of the nozzle may properly be changed depending upon the state or shape of an object to be coated.

The above-described features of the present invention are based on the combination of the specific structure of the twist cap and the aforesaid adapter.

A preferred embodiment of the present invention is described below by reference to FIG. 1.

FIG. 1 is a vertical sectional view showing one example of the twist cap of the liquid foam-discharging squeezable vessel of the present invention, wherein the right half with regard to the center line shows a state of the outer cap in an open state, and the left half a state of the twist cap in a closed state. In FIG. 1, numeral 1 designates an outer cap, and 2 an inner cap, the two caps being combined to constitute a twist cap. Numeral 3 designates a pipe joint tightly inserted into the pipe-shaped portion of the inner cap, which joint has a narrow opening 36 in the middle portion and has a net screen at its top. The inner cap is screwed onto the neck 41 of the vessel body through a screw portion 23 formed inside the periphery extending downward. An opening 24*a* located at about the center of inner cap is covered by a top 25, a plurality of openings 26 are formed in a radial pattern slightly below the top, and a pipe-shaped member having provided on the top of its opening a screen 31 made of a synthetic-fiber or metallic net is tightly inserted into the pipe-shaped portion 21 having an opening communicating to the opening 24*a*. This pipe-shaped member is closely held there in contact with a jaw 28, the lower portion of the pipe-shaped member serving as a pipe joint 3 having an opening for accepting a pipe 44.

In this embodiment, the net screen is disposed at the top of the pipe-shaped member. However, the upper portion of said pipe joint may be replaced by a pipe-shaped ring fully covered with a screen on both ends, as in the aforesaid preceding applications. The screen may be welded to the pipe-shaped member or may merely be disposed in contact with the pipe-shaped member.

At least one continuous vertical groove 34 is formed up to the jaw 37 around the inside wall of the pipe joint, and a pipe 44 for supplying a liquid is inserted into the pipe joint, with the groove being therebetween. This pipe extends to about the bottom of the vessel body.

Figure 2:
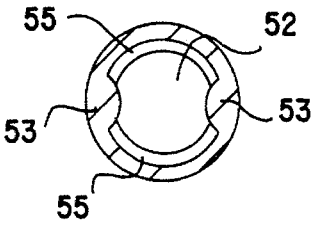
FIG. 2 is a bottom view of the check valve mechanism in the twist cap of a liquid foam-discharging squeezable vessel of the present invention.
Figure 3:
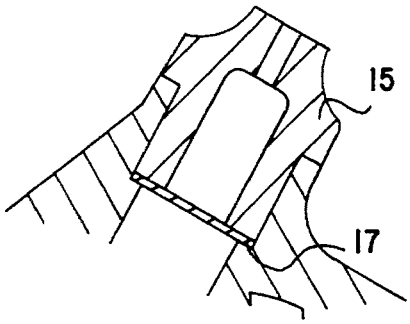
FIG. 3 is a sectional view showing one embodiment of an adapter of the invention in an engaged state.

A check valve mechanism 51 is formed via the wall 27 of pipe-shaped portion and between said pipe-shaped portion and the periphery 22. The check valve mechanism contains therein a stainless steel-made ball 52 capable of vertically freely moving, which ball becomes into a continuous contact with the upper opening 54 to close the opening 54 when pushed up by the fluid from inside, and becomes into a point-to-point contact with supporting pieces 53 when allowed to fall, forming gap 55 between the supporting pieces 53 and the ball 52. (See, FIG. 2 showing a bottom view of the check valve mechanism.)

The mechanism of how the liquid retained in the vessel is foamed by the twist cap is described below.

The outer cap 1 has an opening 11 at its top, and the opening is engaged with a pipe-shaped member 15 (adapter) having a net screen 14 on one end located nearer to the content. It suffices for the adapter to be fully covered by the net screen, and the adapter is not limited as to its shape. In the embodiment shown in FIG. 1, the nozzle 16 has a small diameter, and the screen is applied to the whole opening by adhesion. The screen is not necessarily be adhesively applied, but may merely be sandwiched between the adapter and the jaw.

It is, needless to say, preferable that engagement of the adapter and the vessel opening be in a tight state. As has been described hereinbefore, the opening or nozzle 16 is not limited as to size and shape.

Under the adapter fitted in the opening of the outer cap is formed downward a cyclic interstructure 12 for tightly fitting the top 25 of the pipe-shaped portion of inner cap upon closing the cap. The opening at the top of the outer cap is not limited as to its shape, but is preferably slanted upward as is shown in FIG. 1.

As to the whole shape of the outer cap, any one that permits smooth discharge of liquid foam may be employed. For example, a dome shape is preferred in view of design sense.

The vessel body must be made of such material that enables the vessel to be rapidly restored to its original form upon being unsqueezed. Examples of such material include thermoplastic resins such as polypropylene, polyethylene, polyethylene terephthalate, polyvinyl chloride, and a laminate thereof. Transparent or opaque materials may be employed but, in view of visual check of the amount of the content, transparent or semi-transparent, colored or colorless materials are preferred.

As to materials for constituting the cap, thermoplastic resins such as polypropylene and polyethylene are preferably used, since tight engagement must be established between the cap and the vessel body and between the inner cap and the outer cap.

Figure 4:
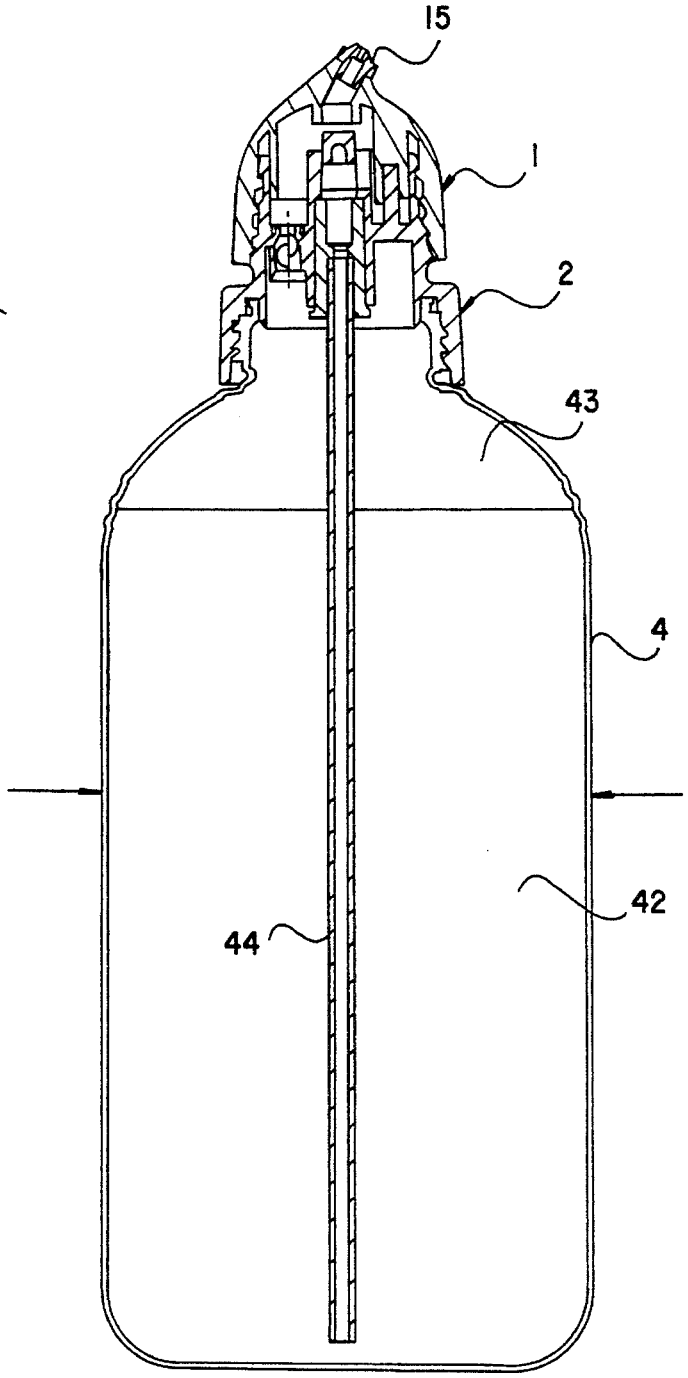
FIG. 4 is a vertical sectional view showing a liquid foam-discharging squeezable vessel of the present invention retining a liquid.

FIG. 4 shows the state of a liquid being retained in the liquid foam-discharging squeezable vessel of the present invention. It is required to provide an air space 43 above the liquid 42 in an amount of about ¼ to about ⅕ of the whole volume of the vessel. Upon application, the body of the vessel is squeezed in directions shown by arrows to push up the liquid 42 to the screen in the inner cap through pipe 44. On the other hand, the air above the liquid travels through vertical groove 34 formed between pipe 44 and pipe joint 3 to the screen in the inner cap, thus the air combining with the liquid to initiate foaming. Further squeezing of the body urges the mixture of air and liquid to pass through the screen to produce finer liquid foam, which is further urged to pass the screen of the adapter fitted in the opening of the outer cap via opening 26 of the pipe-shaped portion 24*a*, thus being discharged through the nozzle 16 of the adapter as much finer foam.

Subsequently, when unsqueezed, negative pressure is produced inside the vessel and, as a result, air enters into the vessel through screen 14 via the nozzle 16.

In this occasion, the passage between the opening 26 of the pipe-shaped portion and the pipe 44 is filled with liquid foam, and the check valve mechanism connecting to the opening 11 is in such state that ball 52 is supported by supporting member 53 and forms gap between the ball and the supporting member, thus external air rapidly entering into the vessel through the gap 55 in the check valve 55.

That is, in the liquid foam-discharging squeezable vessel of the present invention, formation of liquid foam and intake of external air are respectively conducted in two different mechanisms. Employment of the two different mechanisms permits extremely rapid squeezing and unsqueezing operation of the vessel, with the mixing of the liquid and the air being conducted at a constant ratio. The resulting mixture is made into uniform, fine and creamy liquid foam upon passing through at least one screen disposed within the inner cap and one screen disposed in the outer cap. Thus, the liquid foam is rapidly discharged by simple procedure.

The above description is made as to the case of using the vessel with its cap upward. However, it can easily be understood from its structure that the vessel can be used with its cap downward.

Figure 5:
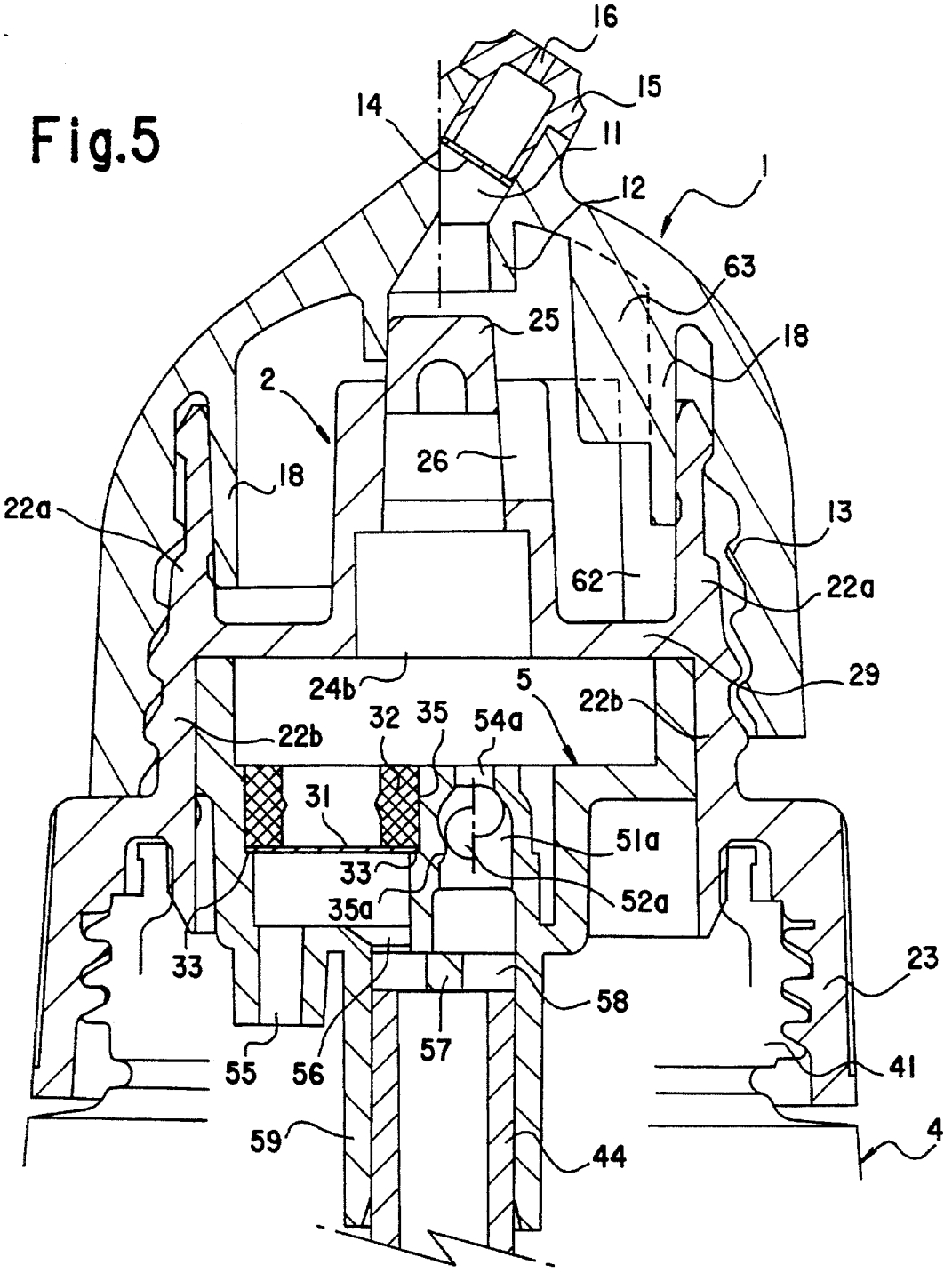
FIG. 5 is a vertical sectional view showing another embodiment of the twist cap of a liquid foam-discharging squeezable vessel of the present invention.

FIG. 5 is a vertical sectional view showing another embodiment of the twist cap of the liquid foam-discharging squeezable vessel in accordance with the present invention. In FIG. 5, the right half with regard to the center line shows a state of the outer cap in an open state, and the left half a state of the twist cap in a closed state, as in FIG. 1. The cap can be in the open state by rotating the outer cap in the counter-clockwise direction.

In this embodiment, too, the inner cap 2 is screwed onto the neck 41 of the vessel body through the screw portion 23 formed inside the periphery extending downward, a pipe-shaped portion is vertically provided at about the center of the inner cap with its top 25 being closed, openings 26 are formed in the interstructure located slightly below for releasing liquid foam, and the openings 26 are preferably formed in a radial pattern for the purpose of rapidly releasing the liquid foam fed under pressure from the lower portion.

A stopper 62 is protrudently provided in the interstructure for limiting rotation of the outer cap, and a horizontal interstructure 29 is formed thereunder, a circular periphery 22*a* is provided upwardly around the horizontal interstructure for fitting with circular rib 18, an inside plug holding portion 22*b* having an opening 24*b* at its center is formed as a part of the interstructure 29, and the outer cap has the same adapter as shown in FIG. 1 inside the opening 11 at its top.

The inside plug 5 is tightly fitted with the periphery 22*b* of the inner cap, and is preferably sealed for avoiding leakage of the liquid through the contact planes. The inside plug fundamentally has a tray-like shape having a plane at about right angle to the periphery, with the same check valve mechanism 51*a* as in FIG. 1 and an adjacent concave 35*a* having a circular plane section being provided in the plane of the tray. A pipe-shaped member 32 having a net screen 31 fully covering one end of its opening is tightly fitted inside the concave in contact with jaw 35. The screen may not necessarily be provided at the bottom of the concave 35*a*, but may be adhesively provided on the upper side of the pipe-shaped member 32. Alternatively, the screen may be adhesively provided at the opening of the tray plane without providing the pipe-shaped member. It is of importance that boundary surface between the check valve mechanism 51*a* and the pipe-shaped member 32 fitted within the concave be tight so as not to leak fluid.

At a position slightly apart from the lower side of the pipe-shaped member 32 is formed an opening 55 connecting to the upper space in the vessel and an opening 56 connecting to a pipe-receiving portion 59 which in turn connects to the lower portion of the check valve mechanism 51*a*. The pipe-receiving portion 59 is formed under the check valve mechanism 51*a* with its top having two openings 56 and 58 connecting to both the check valve mechanism and the pipe-shaped member. A pipe 44 is tightly inserted into the pipe-receiving portion. The top of the pipe is preferably spaced from the end of the pipe-receiving portion 59 by a stopper 57 for effectively ensuring passage of air through the pipe.

The mechanism of how liquid foam is discharged from the twist cap of the above-described constitution is described below.

Firstly, description is given when the vessel is used with the cap upward.

When the vessel in such state is squeezed, the liquid retained in the vessel migrates through the pipe 44 to the openings 56 and 58 but, since the opening 58 is connected to the check valve mechanism 51*a* in which ball 52*a* is pressed against the opening 54*a* by the hydraulic pressure of the liquid to close the opening 54*a*, the liquid can not pass through the check valve. Accordingly, the liquid migrating through the pipe enters into the lower part of the pipe-shaped member through the opening 56. On the other hand, the air existing in the upper space of the vessel also enters into the lower part of the pipe-shaped member through the opening 55, the air is mixed with the liquid at the part to initiate foaming. The thus formed foam is then made finer by means of the screen of the adapter provided inside of the opening of the outer cap, then discharged through the nozzle 16 by the pressure produced by squeezing.

When unsqueezing the vessel, negative pressure is produced inside the vessel, and the external air enters into the vessel through the nozzle 16 of the adapter. In this occasion, the check valve mechanism functions to pass the air through the gap 55 (see FIG. 2) since the ball 52*a* falls to the supporting portion 53*a* due to its own weight whereas the pipe-shaped member provided with the screen is covered by foam which inhibits smooth passing of the air. The air then migrates through the opening 58, 56 and 55 to the air space at the upper part of the vessel space, thus restoring the vessel to its original shape.

Next the mechanism of how liquid foam is discharged when the vessel is used in an inverted state is described below.

When the vessel is used in an inverted state, the liquid exists in the upper part of the vessel whereas the air exists in the lower part thereof. Hence, when squeezing the vessel, air is fed under pressure through the pipe 44, whereas the liquid is fed under pressure through the opening 55 to the pipe-shaped member. In this occasion, the check valve mechanism 51*a* functions to close the passage since the ball 52*a* is pressed against the opening 54*a* due to its own weight and air pressure and, therefore, the air fed through the pipe 44 also passes through the opening 56 to the pipe-shaped member 32. A mixture of the liquid and the air mixed under (over in the inverted state) the pipe-shaped member is made into foam upon passing through the net screen, rendered finer by the screen of the adapter, and discharged through the nozzle 16 under pressure applied from above (in the inverted state).

When the vessel is unsqueezed in the inverted state, the air entering from outside pushes up the ball in the check valve mechanism 51*a*, rapidly migrates through the opening 58 and the pipe 44 to the air space at the bottom of the vessel.

Figure 11:
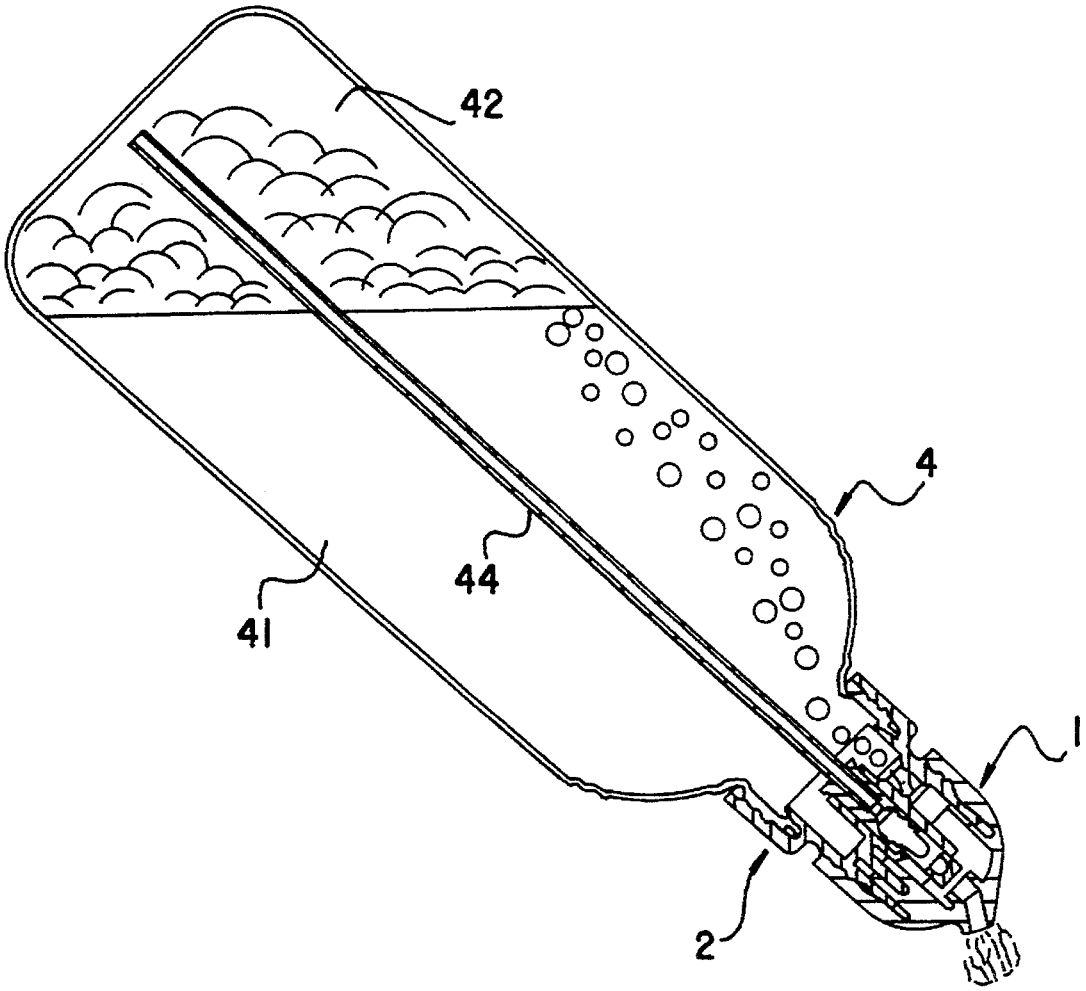
FIG. 11 is a vertical sectional view for illustrating how the air is sucked when the conventional foam-discharging squeezable vessel is in an inverted state.

If the check valve mechanism is provided nearer to the side of the inner cap as in the aforementioned conventional vessels, the external air enters through the liquid to the air space in the vessel as is shown in FIG. 11, and hence the air space is filled with liquid foam which prevents the air from restoring in an enough amount to produce liquid foam in the subsequent squeezing procedure. Thus, in subsequent squeezing, the amount of liquid discharged increases in comparison with the amount of air, failing to produce fine foam and partly discharging liquid as it is.

Figure 6:
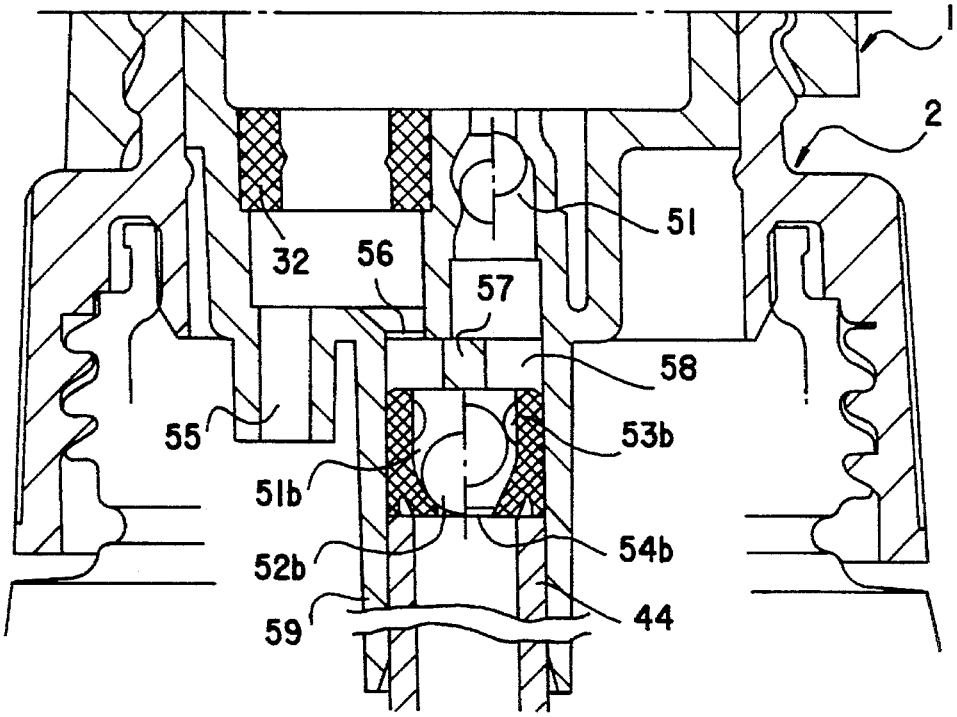
FIG. 6 is a vertical sectional view showing an embodiment wherein two check valve mechanisms are provided in an inside plug.

A further embodiment of the present invention is described below by reference to FIG. 6.

This embodiment is characterized in that an additional check valve mechanism 51*b* is provided at the top of pipe located under the center of the inside plug.

In this embodiment, the additional check valve mechanism having the same outer diameter as that of pipe 44 is provided in an opposite pattern so as to function reversely to the check valve 51. Namely, the opening 54*b* to be closed by the ball is in contact with the top of the pipe, whereas ball-supporting portion 53*b* is formed in the vicinity of the openings 56 and 58. Hence, the external air enters directly into the opening 56 through the opening 58, which serves for the external air to rapidly enter into the vessel. This embodiment enables one to discharge liquid foam more rapidly.

A further embodiment of the twist cap in accordance with the present invention is described below by reference to FIGS. 1, and 7 through 10.

In this embodiment, a sound-producing boss 61 is protrudently provided on the interstructure 29 of the inner cap as is shown in FIGS. 1, 7, 8, and 10. Stoppers 62*a* and 62*b* controlling the open-close operation of the twist cap are formed in the vicinity of the sound-producing boss in the form spreadingly protruding from the central, pipe-shaped interstructure 27 to the periphery 22. Stopper 63 is formed downward on the inner surface of the outer cap, which stopper can be climbed over by the top of said sound-producing boss 61 and has a plane section of U-shape. This stopper 63 is so constituted that, when the sounding boss climbs over the second interstructure 65, it can hit the first interstructure 64 on the opposite side to produce a sound with its own repulsive power and, at the same time, the second interstructure 65 can be fitted with the stopper 62 in a plane-to-plane contact.

That is, the stopper 62*a* of the inner cap functions to adjust so that, when the outer cap is rotated to open, the nozzle 16 may be stopped always at a convenient position. This function is particularly important with respect to flat bottles. FIG. 10 show a preferable open state wherein the stopper 62*a* and the second interstructure 65 of the outer cap are in contact with each other.

Another stopper 62*b* of the inner cap is provided for the purpose of preventing overrunning of the screw fitting between the inner and outer caps upon closing the outer cap or for preventing screw fitting between the inner and outer caps from getting off when the outer cap too tightly closed is rotated by too much strength. That is, the stopper 62*b* becomes into contact with the first interstructure 64 of the outer cap to prevent too much closing.

The stoppers 62*a* and 62*b* are not necessarily be separately formed but may be combined to form one fan-shaped stopper.

Figure 7:
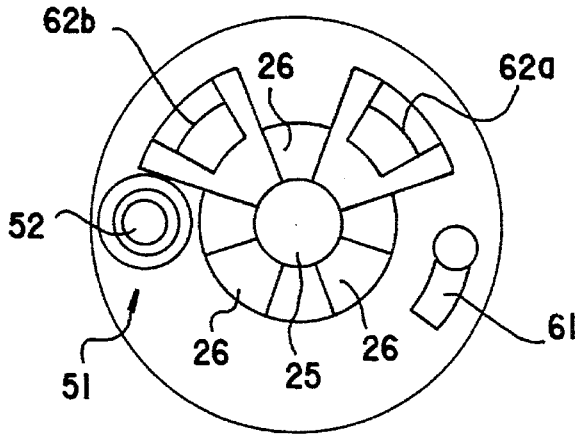
FIG. 7 is a partial plane view showing the structure of a sound-producing boss provided in the inner cap of one embodiment of the twist cap of the present invention.

The sound-producing boss is formed on the interstructure 29 of the inner cap as a rod having an enough give at its top and, in order that it does not undergo deformation even after repeated open-close procedures with maintaining a proper give, the sound-producing boss preferably has a structure of gradually extending downward in the rotation direction as is shown in FIGS. 7 and 9.

The above-described embodiment is characterized in that completion of cap-opening or closing procedure can be confirmed by the sound produced by the sound-producing boss with the repulsive force thereof.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A liquid foam-discharging squeezable vessel, comprising a squeezable vessel body; and a twist cap screwed onto the body, wherein said twist cap comprises an outer cap and an inner cap, said inner cap being screwed onto the neck of the vessel body by a screw portion extending downwardly formed inside the periphery of said inner cap, two independent fluid-passing mechanisms being provided at about a center portion of said vessel and at a position adjacent to the center portion within the inner cap, one of said fluid-passing mechanisms being a pipe-shaped member functioning as a check valve mechanism which contains therein a vertically movable ball, wherein said pipe-shaped member has an upper opening and is capable of coming into continuous contact with said ball, wherein said pipe-shaped member further has a lower opening and is capable of coming into point-to-point contact with said ball, the other fluid-passing mechanism being another inserted pipe-shaped portion having an opening fully covered by a net screen and further having a mixing chamber formed therein, and the outer cap having a nozzle fully covered with another net screen on one end located nearer to the contents of the vessel, wherein said pipe-shaped portion includes grooves at a lower portion thereof and away from said net screens for passing therethrough air for mixing with liquid in a mixing chamber to form foam, said grooves directly abutting a narrow opening which in turn directly abuts a central portion of said mixing chamber.

2. A liquid foam-discharging squeezable vessel, comprising a squeezable vessel body; and a twist cap screwed onto the body, wherein said twist cap comprises an inner cap screwed onto the neck of said vessel body by a screw portion extending downwardly formed inside the periphery of said inner cap and having two independent fluid-passing mechanisms at about a center portion of said vessel and an outer cap rotatably screwed onto said inner cap capable of being rotated within a definite angle, a first one of said fluid-passing mechanisms at about the center portion having a closed top, at least one opening for discharging the liquid foam at slightly below the top, and a pipe-shaped portion therebelow having a pipe joint-receiving portion fluidly connected to the opening, said pipe-shaped portion having a mixing chamber and a net screen over an entire top end thereof and having an opening with vertical grooves on an inside surface thereof for accepting a pipe being tightly inserted into said pipe joint-receiving portion, a pipe extending to about the bottom of the vessel, and a second one of said fluid-passing mechanisms being another pipe-shaped portion having two openings on the upper and lower ends thereof and a vertically freely movable ball, with the upper opening being able to come into continuous contact with said ball and the lower opening being able to come into point-to-point contact with said ball, thus functioning as a check valve, wherein said pipe-shaped portion includes said grooves at a lower portion thereof and away from said net screen for passing therethrough air for mixing with liquid in the mixing chamber to form foam, said grooves directly abutting a narrow opening which in turn directly abuts a central portion of said mixing chamber.

3. A liquid foam-discharging squeezable vessel, comprising a squeezable vessel body; and a twist cap screwed onto the body, wherein said twist cap comprises an inner cap screwed onto the neck of said vessel body through a screw portion extending downwardly formed inside the periphery of said inner cap extending downward and an outer cap rotatably screwed onto said inner cap capable of being rotated within a definite angle, a pipe-shaped portion having a closed top and at least one opening for discharging liquid foam being vertically formed at about the center of said inner cap, a horizontal interstructure being formed below said pipe-shaped portion, an inside plug-holding portion having a circular periphery and an opening at the center being downwardly formed along the interstructure, a substantially tray-shaped inside plug being tightly engaged with said inside plug-holding portion, said inside plug having a periphery formed upward which abuts said circular periphery of said plug-holding portion and and a plane extending at about right angle to the periphery, another pipe-shaped portion having openings on the upper and lower ends thereof and containing at least one vertically freely movable ball being formed as a check valve mechanism at about a center of the plane, and a fluid-passing portion having tightly disposed therein a pipe-shaped member fully covered with a net screen on an opening thereof and being formed adjacent to the check valve mechanism, wherein said pipe-shaped portion includes a mixing chamber and openings at a lower portion thereof and away from said net screen for passing therethrough air for mixing with liquid in the mixing chamber to form foam, said openings directly abutting the mixing chamber.

4. The liquid foam-discharging squeezable vessel as set forth in one of claims 1 through 3, wherein said twist cap has a sound-producing boss protrudingly formed on an interstructure of said inner cap, a first stopper protruding from the periphery of said pipe-shaped portion toward the vicinity of said sound-producing boss, and a second stopper with a U-shaped plane capable of coming into contact with the first stopper when top of the boss climbs over the interstructure to fit being formed inside the outer cap.

* * * * *